US009506385B2

(12) United States Patent
Khadiya et al.

(10) Patent No.: US 9,506,385 B2
(45) Date of Patent: Nov. 29, 2016

(54) FUEL FIRED BURNER FOR VEHICLE EXHAUST COMPONENT

(75) Inventors: Navin Khadiya, Columbus, IN (US); Nicholas J. Birkby, Preston (GB); Steven Beesley, Preston (GB); Mark Ramsbottom, Millhead (GB); Philip M. Dimpelfeld, Columbus, IN (US)

(73) Assignee: Faurecia Emissions Control Technologies, USA, LLC, Columbus, IN (US)

( * ) Notice: Subject to any disclaimer, the term of this patent is extended or adjusted under 35 U.S.C. 154(b) by 1553 days.

(21) Appl. No.: 12/836,761

(22) Filed: Jul. 15, 2010

(65) Prior Publication Data

US 2012/0011835 A1 Jan. 19, 2012

(51) Int. Cl.
*F01N 3/10* (2006.01)
*F01N 3/025* (2006.01)

(52) U.S. Cl.
CPC ..... *F01N 3/025* (2013.01)

(58) Field of Classification Search
CPC ..... F01N 3/025
USPC ..... 60/295, 297, 311
See application file for complete search history.

(56) References Cited

U.S. PATENT DOCUMENTS 4,604,868 A * 8/1986 Nomoto et al. ..... 60/286
4,651,524 A * 3/1987 Brighton ..... 60/274
4,951,464 A 8/1990 Eickhoff et al.
4,987,738 A * 1/1991 Lopez-Crevillen et al. ... 60/286
5,001,899 A 3/1991 Santiago et al.
5,140,814 A * 8/1992 Kreutmair et al. ..... 60/303
5,417,059 A * 5/1995 Hartel et al. ..... 60/276
5,456,079 A * 10/1995 Langen ..... 60/286
2005/0150215 A1* 7/2005 Taylor et al. ..... 60/295

FOREIGN PATENT DOCUMENTS

EP 1752633 2/2007
JP 2005232975 A 9/2005
KR 100836261 B1 6/2008

OTHER PUBLICATIONS

International Search Report, dated Feb. 27, 2012.

* cited by examiner

*Primary Examiner* — Kenneth Bomberg
*Assistant Examiner* — Matthew T Largi
(74) *Attorney, Agent, or Firm* — Carlson, Gaskey & Olds, PC

(57) ABSTRACT

A fuel fired burner defines an axially extending flow path. An airless fuel nozzle sprays fuel droplets within the fuel fired burner in a direction generally along the axially extending flow path. An exhaust gas inlet directs exhaust gases from a vehicle exhaust system toward the airless nozzle in a direction that is transverse to the axially extending flow path. The exhaust gas mixes with the fuel droplets resulting in an exhaust gas/fuel mixture.

18 Claims, 1 Drawing Sheet

FUEL FIRED BURNER FOR VEHICLE EXHAUST COMPONENT

TECHNICAL FIELD

This invention generally relates to a fuel fired burner for a vehicle exhaust component that includes an airless nozzle.

BACKGROUND OF THE INVENTION

Fuel fired burners are desirable for reliable regeneration of diesel particulate filters (DPFs) as well as for thermal management of other exhaust catalysts and components. For example, a DPF can become clogged over time, which decreases engine operating efficiency. These particulate filters can be regenerated to burn off the trapped particulate matter. The fuel fired burner is used to generate/increase heat such that the particulate matter can be burned off. Typically, the fuel delivery system of a fuel fired burner has an air flow and a fuel flow that provide a fuel/air mixture via a nozzle. An igniter ignites the fuel/air mixture sprayed from the nozzle to increase heat for regeneration or thermal management of aftertreatment.

In certain applications, an airless nozzle configuration is used instead of a fuel/air mixture configuration. An airless nozzle is desirable because this type of nozzle eliminates parasitic loss of compressed air, as well as eliminating the additional cost and complexity due to added components to supply air. In this type of configuration, the nozzle receives only a fuel supply and does not include a source of compressed air. Exhaust gas flows in an axial direction along the nozzle and mixes with fuel droplets sprayed from the nozzle. An igniter then ignites the mixture of exhaust gas and fuel droplets.

One concern with an airless nozzle is fuel coking within the nozzle as well as the associated fuel line if it is exposed to heat. During engine operation, the fuel can undergo chemical changes leading to the formation of carbon based dry materials that can plug the nozzle. This chemical degradation of the fuel is often referred to as fuel "coking."

SUMMARY OF THE INVENTION

A fuel fired burner with an airless fuel supply nozzle includes an exhaust gas side entry configuration.

In one example, the fuel fired burner defines an axially extending flow path. The airless fuel nozzle sprays fuel droplets within the fuel fired burner in a direction generally along the axially extending flow path. An exhaust gas inlet directs exhaust gases from a vehicle exhaust system toward the airless nozzle in a direction that is transverse to the axially extending flow path. The exhaust gas mixes with the fuel droplets resulting in an exhaust gas/fuel mixture. An igniter then ignites the mixture to increase the temperature of the exhaust gases as needed.

The heated exhaust gases are directed to an exhaust component in a vehicle exhaust system. In one example, the exhaust component comprises a diesel particulate filter.

In one example, the fuel fired burner includes a housing extending along a length that is greater than a width. The airless nozzle is positioned at one end of the housing and an exhaust gas outlet is positioned at an opposite end of the housing. The exhaust gas inlet is positioned on a side of the housing at a location between the nozzle and the exhaust gas outlet.

In one example, an inner chamber is positioned within the housing. The inner chamber has one end at the airless nozzle and an opposite end facing the exhaust gas outlet. The inner chamber can include one or more openings as needed.

These and other features of the present invention can be best understood from the following specification and drawings, the following of which is a brief description.

DETAILED DESCRIPTION OF THE PREFERRED EMBODIMENT

Figure 1:
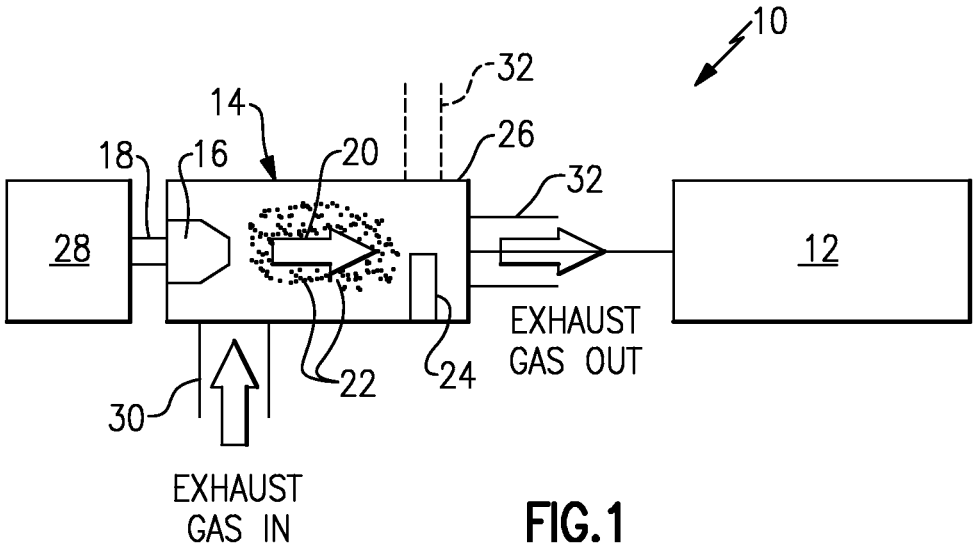
FIG. 1 is a schematic representation of a vehicle exhaust system having a fuel fired burner incorporating the subject invention.

As shown in FIG. 1, a vehicle exhaust system 10 includes at least one exhaust component 12 that traps particulate matter, such as a diesel particulate filter (DPF) for example. A fuel fired burner 14 generates heat such that trapped particulate matter can be burned off in a regeneration cycle for the exhaust component 12. It should be understood that while the example is directed to a diesel particulate filter, the fuel fired burner can be used with any vehicle exhaust component for regeneration purposes or for heating purposes.

The fuel fired burner 14 includes an airless nozzle 16 that is positioned within a housing 26 having a length extending between opposed ends and a width defined in a radial direction. In one example, airless nozzle 16 receives fuel via a fuel line 18 connected to a fueling system, schematically shown at 28, which includes a source of pressurized fuel and other associated fuel supply components such as injectors, valves, etc. Any type of fuel supply system for an airless injector configuration can be used to supply fuel to the airless nozzle 16. For example, a metering device, such as an automotive type fuel injector, can be connected via a fuel line to a fuel spray nozzle, or a fuel injector can be used to directly spray into the burner.

The fuel fired burner 14 defines an axially extending flow path 20 along a length of the housing 26 of the fuel fired burner 14. Fuel droplets 22 are sprayed by the airless nozzle 16 and mix with the exhaust gas to form an exhaust gas/fuel mixture that is then subsequently ignited by an igniter 24. Any type of igniter 24 can be used such as one or more electrodes, for example.

Exhaust gas is introduced for mixture with the fuel droplets 22 via an inlet 30. The inlet 30 comprises a side-entry configuration to the housing 26 where exhaust gas is directed toward the airless nozzle 16 in a direction that is transverse to the axially extending flow path 20. This side introduction of exhaust gas induces a swirl in the incoming exhaust gas without the need for any other components, such as a mixing element for example. This swirling action of the exhaust gas can result in a more evenly distributed and thoroughly mixed fuel/exhaust gas mixture. Further, this side entry configuration reduces fuel coking within the nozzle.

It should also be understood that while the side entry configuration for the airless nozzle is shown as being used with a fuel fired burner for a DPF, the subject airless system could also be used with other types of exhaust components 12 where fine accurate sprays are required. Examples include: Hydrocarbon Dosing of a Diesel oxidation catalyst and dosing of urea in a SCR system for NOx reduction.

Once the exhaust gas/fuel mixture has been ignited the heated exhaust gases exit the fuel fired burner 14 via an outlet 32. In one example, the outlet 32 is at one end of the housing 26 and the airless nozzle 16 with the fuel line connection to the fuel supply system 28 is at an opposite end of the housing 26. In another example, the outlet 32 could be located along a side of the housing 26 in a radial configuration as indicated by the dashed lines in FIG. 1. The exhaust gas inlet 30 is positioned along a side of the housing 26 at a location between the airless nozzle 16 and the exhaust gas outlet 32.

As discussed above, the airless nozzle 16 receives fuel via the fuel line 18 connected to the fuel supply system 28. The side entry configuration reduces exposure of the fuel line 18 to heated exhaust gases, which in turn reduces coking within the fuel line itself.

Figure 2:
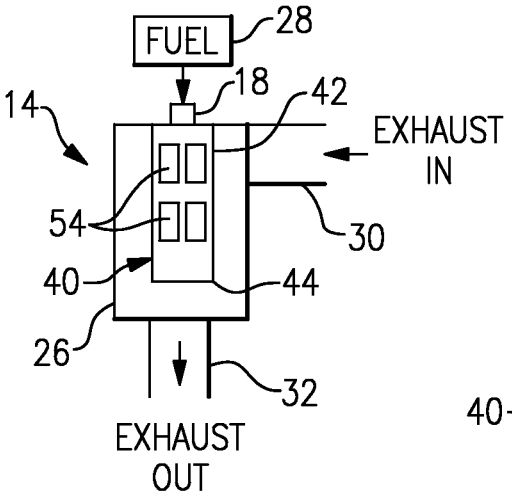
FIG. 2 is a schematic view of the fuel fired burner of FIG. 1 with an inner chamber.
Figure 3:
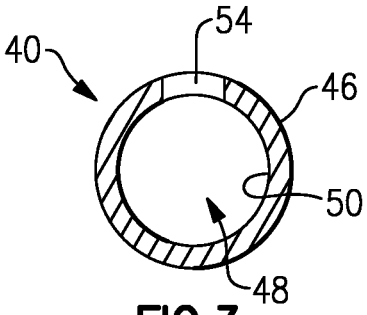
FIG. 3 is a cross-sectional view through one example inner chamber.

In one example, an inner chamber 40 is positioned within the housing 26 of the fuel fired burner 14 as shown in FIG. 2. The inner chamber 40 extends along a length and has one end 42 at the airless nozzle 16 and an opposite end 44 facing the exhaust gas outlet 32 that is co-axial with the axially extending flow path 20. The inner chamber 40 comprises an outer surface 46 and an open interior 48 defined by an inner surface 50 as shown in FIG. 3. The open interior 48 comprises a chamber flow path that is co-axial with the axially extending flow path 20. The airless nozzle 16 sprays the fuel droplets 22 into the open interior 48. The inclusion of the inner chamber 40 provides a more favorable environment for a flame generated by ignition of the exhaust gas/fuel mixture.

In one example, the outer surface 46 of the inner chamber 40 includes at least one opening 54 into the open interior 48 as shown in FIG. 3. In the example shown in FIG. 2, the at least one opening 54 comprises a plurality of openings 54. The openings 54 further enhance flow and flame stability.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A vehicle exhaust system comprising:

a fuel fired burner defining an axially extending flow path;

an airless fuel nozzle receiving a fuel supply from a fuel source, said airless fuel nozzle adapted to spray droplets within said fuel fired burner in a direction generally along the axially extending flow path; and an exhaust gas inlet that directs exhaust gases toward said airless nozzle in a direction that is transverse to the axially extending flow path.

2. The vehicle exhaust system according to claim 1 wherein said exhaust gas inlet directs exhaust gases toward said airless nozzle in a direction that is perpendicular to the axially extending flow path.

3. The vehicle exhaust system according to claim 1 including an igniter that ignites an exhaust gas/fuel mixture to produce heated exhaust gases.

4. The vehicle exhaust system according to claim 3 including an exhaust gas outlet that directs the heated exhaust gases away from the fuel fired burner along the axially extending flow path.

5. The vehicle exhaust system according to claim 1 including an exhaust component that receives the heated exhaust gases.

6. The vehicle exhaust system according to claim 5 wherein said exhaust component comprises a diesel particulate filter.

7. The vehicle exhaust system according to claim 1 including a fuel line that directs the fuel supply from the fuel source to said airless fuel nozzle, wherein said fuel line is separated from said exhaust gas inlet.

8. The vehicle exhaust system according to claim 7 wherein said fuel line supplies fuel to said airless nozzle in a direction that is non-coaxial with said exhaust gas inlet.

9. The vehicle exhaust system according to claim 1 including an inner chamber positioned within said fuel fired burner, said inner chamber having one end facing said airless nozzle and an opposite end facing an exhaust gas outlet that is co-axial with the axially extending flow path.

10. The vehicle exhaust system according to claim 9 wherein said inner chamber comprises an outer surface and an open interior defined by an inner surface, said open interior comprising a chamber flow path that is co-axial with the axially extending flow path, and wherein said airless nozzle sprays fuel droplets into said open interior.

11. The vehicle exhaust system according to claim 10 wherein said outer surface of said inner chamber includes at least one opening into said open interior.

12. The vehicle exhaust system according to claim 11 wherein said at least one opening comprises a plurality of openings.

13. The vehicle exhaust system according to claim 1 wherein said fuel fired burner comprises a housing having a length extending along the axially extending flow path with one housing end associated with said airless nozzle and an opposite housing end associated with an exhaust gas outlet, and wherein said exhaust gas inlet is formed in a side of said housing at a position that is axially between said airless nozzle and said exhaust gas outlet.

14. The vehicle exhaust system according to claim 1 wherein said fuel fired burner comprises a housing having a length extending between a first end and a second end, and including an exhaust gas outlet that directs heated exhaust gases away from the fuel fired burner, said exhaust gas outlet being positioned along a side of said housing at a location between said first and second ends.

15. The vehicle exhaust system according to claim 1 wherein said airless fuel nozzle comprises one of a metering device or fuel injector.

16. The vehicle exhaust system according to claim 1 wherein all exhaust gas flows through the fuel-fired burner.

17. The vehicle exhaust system according to claim 1 including an exhaust gas outlet that directs the heated exhaust gases away from the fuel fired burner in a direction transverse to the axially extending flow path.

18. The vehicle exhaust system according to claim 10 including an igniter that ignites an exhaust gas/fuel mixture to produce heated exhaust gases, and wherein said igniter is mounted adjacent to said opposite end of said inner chamber.

* * * * *